US009328996B1

(12) United States Patent
Lia et al.

(10) Patent No.: US 9,328,996 B1
(45) Date of Patent: May 3, 2016

(54) BOW SIGHT HAVING EXTENDED ACCURACY RANGE

(71) Applicants: Raymond A. Lia, Auburn, NY (US); Scott S. Stearns, Marietta, NY (US)

(72) Inventors: Raymond A. Lia, Auburn, NY (US); Scott S. Stearns, Marietta, NY (US)

( * ) Notice: Subject to any disclaimer, the term of this patent is extended or adjusted under 35 U.S.C. 154(b) by 157 days.

(21) Appl. No.: 14/156,089

(22) Filed: Jan. 15, 2014

Related U.S. Application Data

(60) Provisional application No. 61/753,308, filed on Jan. 16, 2013.

(51) Int. Cl.
*F41G 1/467* (2006.01)

(52) U.S. Cl.
CPC ..... *F41G 1/467* (2013.01)

(58) Field of Classification Search
CPC ..... F41G 1/467; F41G 1/345; F41G 1/473; F41G 1/30; F41B 5/14
USPC ..... 33/265; 124/87
See application file for complete search history.

(56) References Cited

U.S. PATENT DOCUMENTS

| | | | | |
|---|---|---|---|---|
| 2,001,470 | A | 5/1935 | Nyvall | |
| 2,788,701 | A | 4/1957 | Browning | |
| 3,163,697 | A | 12/1964 | White | |
| 3,433,552 | A * | 3/1969 | Korones et al. | 33/265 |
| 3,524,440 | A | 8/1970 | Hill | |
| 3,861,051 | A * | 1/1975 | Killian | 33/265 |
| 3,966,298 | A | 6/1976 | Chapman | |
| 4,174,836 | A | 11/1979 | Kearney | |
| 4,178,693 | A | 12/1979 | Smith | |
| 4,291,937 | A | 9/1981 | Baudot | |
| 4,294,017 | A | 10/1981 | Byrnes et al. | |
| 4,336,743 | A | 6/1982 | Horn et al. | |
| 4,375,725 | A | 3/1983 | Orlob | |
| 4,434,702 | A | 3/1984 | Rozner et al. | |
| 4,449,817 | A | 5/1984 | Abler | |
| 4,462,684 | A | 7/1984 | Abler | |
| 4,507,874 | A | 4/1985 | Brown | |
| 4,555,856 | A | 12/1985 | Brown | |
| 4,587,845 | A | 5/1986 | Varga | |
| 4,647,967 | A | 3/1987 | Kirschner et al. | |
| 4,733,474 | A | 3/1988 | Cary | |
| 4,859,045 | A | 8/1989 | Dagan et al. | |
| 4,878,305 | A | 11/1989 | Gabrielidis | |
| 4,953,302 | A | 9/1990 | Gould | |
| 4,978,206 | A | 12/1990 | Neuman et al. | |
| 4,979,309 | A | 12/1990 | Oligschlaeger | |
| 5,060,554 | A | 10/1991 | Aharon | |
| 5,134,519 | A | 7/1992 | Abele et al. | |
| 5,151,677 | A | 9/1992 | Gernet et al. | |
| 5,351,671 | A | 10/1994 | Cervera | |
| 5,435,068 | A | 7/1995 | Thames et al. | |
| 5,630,279 | A * | 5/1997 | Slates | 33/265 |
| 5,815,302 | A | 9/1998 | Mc Vey et al. | |
| 6,065,254 | A | 5/2000 | Lanka | |
| 6,122,100 | A | 9/2000 | Miller | |
| 6,191,574 | B1 | 2/2001 | Dilger | |
| 6,247,237 | B1 | 6/2001 | Redburn et al. | |

(Continued)

*Primary Examiner* — Yaritza Guadalupe-McCall
(74) *Attorney, Agent, or Firm* — Barclay Damon, LLP

(57) ABSTRACT

A sight for a projectile launching device, such as an archery bow, that enables a viewing line of sight which closely matches a portion of a curved projectile path of flight to attain an extended accuracy range. The sight includes a set of mirrors arranged periscopically and mounted to the launching device. For example, the sight can be provided integrally or through mounting to an archery bow in the location and manner of traditional aiming point pin sights.

20 Claims, 3 Drawing Sheets

(56) References Cited

U.S. PATENT DOCUMENTS

| | | | | |
|---|---|---|---|---|
| 6,347,010 | B1 | 2/2002 | Chen et al. | |
| 6,539,637 | B1 * | 4/2003 | Hollabaugh | 33/265 |
| 6,550,418 | B2 | 4/2003 | Williamson | |
| 6,634,111 | B2 | 10/2003 | LoRocco | |
| 6,715,227 | B2 | 4/2004 | Swain | |
| 6,817,105 | B2 | 11/2004 | LoRocco | |
| 7,062,796 | B1 | 6/2006 | Dixon | |
| 7,065,917 | B2 | 6/2006 | Lahti | |
| 7,508,445 | B2 | 3/2009 | Cirami | |
| 7,574,810 | B1 * | 8/2009 | LoRocco | 33/265 |
| 7,752,798 | B2 | 7/2010 | Mayerle | |
| 8,051,574 | B1 * | 11/2011 | Kronengold et al. | 33/265 |
| 8,171,648 | B2 | 5/2012 | Summers et al. | |
| 8,176,644 | B1 | 5/2012 | Summers et al. | |

* cited by examiner

BOW SIGHT HAVING EXTENDED ACCURACY RANGE

CROSS REFERENCE TO RELATED APPLICATION

This application claims priority from U.S. Patent Application 61/753,308, filed on Jan. 16, 2013, and entitled: BOW SIGHT WITH LARGE ACCURACY RANGE, the entire contents of this application being herein incorporated by reference.

TECHNICAL FIELD

The application generally relates to the field of projectile launching devices. More specifically and according to one version, this application relates to equipping a projectile launching device, such as an archery bow with a sight including an aiming device that provides extended accuracy range without the need for estimating or measuring distance to an intended target. More particularly, the sight includes a fixed set of mirrors disposed in relation to each other and arranged as in a periscope for mounting on or integration with an archery bow or other projectile launching device such that the line of sight closely matches the path of flight of the projectile over a predetermined range.

BACKGROUND

It is extremely difficult to master the art of archery as many variables affect the accurate delivery of an arrow to a desired target. One of the most difficult variables is an accurate estimation of the distance from the archer to the intended target (the "target distance"). An arrow falls to earth at an accelerating rate on its way to the target due to the effects of gravity. This is the nature of the trajectory of any projectile. The archer requires extreme accuracy in range estimation in order to effectively place an arrow at a desired target. The use of an aiming point (e.g., at least one sight pin) in conjunction with a peep sight (e.g., an eyelet hole) on the string of a bow can provide this accuracy if the exact distance to the target can be ascertained. However, a separate sight pin or adjustable sight pin is then additionally required for each incremental target distance. FIG. 1 schematically illustrates this concept. The eye 10 of the archer (not shown) is aligned with an aiming point pin 13 located at the bow 15 to form a sight axis 17 that linearly extends through an intended target 20. The arrow 19 must be launched by tilting the bow 15 upward at a slight angle of a few degrees, as shown, in order to overcome gravitational acceleration. This defined curve 21, representative of the flight path of the arrow 19, passes through the sight axis 17 at two points, a first point 25 in a proximate area in which the arrow 19 is initially launched and a second point 27 on the way down. The effective target distance is typically mapped at the second point 27 on the way down where the arrow 19 intersects the sight axis 17 at the intended target 20. This is the distance that the archer is interested in hitting the target 20 with the arrow 19. With a traditional single aiming point sight device and as shown in FIG. 1, the effective accuracy of the bow 15, shown schematically by the boxes labeled with reference numerals 29, 31, is good for only a few yards in front and behind the target 20, respectively.

To that end, numerous drawbacks exist in the reliability and effective use of prior art sighting devices for archery bows as well as other launching devices in which a projectile is directed (i.e., launched) at a target and is influenced by gravity. Various target distance aiming devices (i.e., rangefinders) have been devised, including some that employ mirrors. All of these devices, however, are configured to require the user, such as a bow hunter, to make some sort of real time adjustment during the act of aiming in addition to judging the target distance.

In the field of archery, various bow sights have been shown for increasing the archer's accuracy, but these sights have acted merely as rangefinders. For example, U.S. Pat. No. 2,001,470 describe a folding bow having a top and bottom mirror acting as a periscope to reflect an image of the target to the eye of the archer. The lower mirror is rotationally articulated to align cross hairs on the lower mirror with the target. The lower mirror must be rotated to pre-arranged positions, which relate to various distances which the archer must estimate by other methods.

U.S. Pat. No. 3,163,697 shows a dual spaced mirror device arranged such that the viewer (archer) will simultaneously see both a real and a reflected target image. As a viewer looks at the target, a slide is manipulated until real and reflected images are both seen at the same height. At this position, the bow is aimed at the target and is properly positioned such that an arrow will assume the proper trajectory to the target.

U.S. Pat. No. 3,524,440 describes a mirror sighting device with respectively arranged upper and lower mirrors with cross hairs being added onto one of the mirrors. The lower mirror of this device is focused on the target while the upper mirror is focused on the lower mirror and reflects the target image to the archer's eye. The mirror mounting the cross hairs may be adjusted vertically in order to compensate for distance to the target.

U.S. Pat. No. 2,788,701 describes a device which incorporates multiple mirrors that are mounted below a single upper mirror for reflecting the image of the target and transmitting the image to the eye at various levels to facilitate trajectory adjustment of the bow for delivery of an arrow to the target.

U.S. Pat. No. 4,178,693 relates to an archery bow sight and range finder, including a pair of vertically spaced and laterally extending mirrors slidably mounted on a bow attached bracket and finger trigger which is actuable by the archer when grasping and aiming the bow. A center bead is associated with the lowermost mirror and the angle of the upper mirror is changed by trigger action to vary the elevation angle of the bow, with split image viewing being employed, combined with trigger action, to locate the exact range of target, one half of the target being viewed directly and the remaining half being seen through the mirrors. A lateral point of aim is determined by the lower mirror bead being positioned in the center of the combined split image.

U.S. Pat. No. 4,507,874 describes a bow sight which is characterized by a periscope device enclosing a top mirror and a bottom mirror to direct an image of a target to the eye of the archer. A compensating mirror is also mounted in the periscope in parallel adjustable relationship with respect to the top and bottom mirrors. A split target image is viewed in the fixed bottom mirror and comparison of this split image facilitates raising the bow to a proper angle in order to compensate for the trajectory of an arrow.

U.S. Pat. No. 4,555,856 describes a bow sight which includes, a housing enclosing a bottom mirror, a top mirror mounted in spaced relationship in the housing with respect to the bottom mirror and a narrow compensating mirror positioned in the housing in close proximity to the bottom mirror. The top and bottom mirrors are mounted in substantially parallel relationship at approximately a 45 degree angle in the housing and the top mirror and the compensating mirror are pivotally mounted with the compensating mirror adjustably responsive to manipulation of a lever from a calibrated position. The target image segment projected from the top mirror to the bottom mirror is compared to the target image segment projected from the compensating mirror to the bottom mirror and the lever is moved in order to provide the necessary adjustment to align the segments and determine a proper trajectory for accurately delivering an arrow to the target.

U.S. Pat. No. 4,979,309 describes a range finding bow sight for archery bows which includes a frame on which are mounted upper and lower mirrors in a substantially parallel relationship at a 45 degree angle and vertically aligned with each other forwardly of the bow. The top mirror is pivotally mounted and adjustably responsive to manipulation of a lever, which cooperates through a programmed cam segment on a rotationally mounted sighting plate to which is attached a sight pin. Movement of the actuating lever correspondingly shifts the upper mirror to permit alignment of the actual target image with a reflected target image from the lower mirror. Movement of the actuating lever simultaneously positions the sight pin to provide the necessary elevation of the bow for the proper trajectory of the arrow to the target. The programmed cam section is removable and can be shaped to match the performance characteristics of the archery equipment being used.

None of the above-noted prior art, nor any that Applicants are presently aware, solve the general and persisting need in the archery industry, at a minimum, to provide a sight that is readily adaptable to long bows, recurve bows, compound bows, cross bows, and other projectile devices, which can accurately aim over various distances between the user and an intended target without the need to estimate or measure the target distance.

BRIEF DESCRIPTION

By way of example, and as clearly shown in FIG. 1, a fundamental problem with archery bow sights is that the path of flight 21 of the arrow 19 is defined by a curve, while the visual line of sighting 17 of a bow sight is defined by a straight line, therefore making it necessary to have a separate line of sight for each known target distance. The arrow launch must be angled upward precisely to compensate for the gravitational acceleration acting to pull the arrow 19 to the ground. Typically and with reference to FIG. 1, the location of an adjustable aiming point pin 13 is mounted to the bow frame 15 that the archer (e.g., a bow hunter) aligns with his/her eye 10 to create a visual aim line or line of sight 17 at a target 20. By trial and error, the hunter will adjust the aiming point pin location for elevation and windage (up/down and left/right) until the arrow strikes the intended target accurately at a given target distance. The hunter must then repeat this process for several other target distances, using a separate aiming point pin (not shown) for each target distance. Alternatively, another type of known sight requires vertical adjustment of a single pin (i.e., up and down) using a lever mechanism to create multiple aim points. In this latter case, the calibration requires the archer to mark the lever position for each calibration target distance. During use, the archer would have to move the lever to the appropriate marking based on the target distance. In either known instance, the hunter is expected to judge the target distance and then select the correct line of sight (aiming point) for that distance.

This aiming method would be adequate if the archer always knew the exact distance to the targets that randomly appear, such as those commonly occurring while hunting. Distance judging and sight adjustments during use is a source of accuracy error. Not knowing the distance means the hunter must quickly judge the distance to the best of his/her ability and often times is wrong, thus having sometimes a large error between the aiming sight and the arrow flight. As a result, the intended target is missed.

According to the present invention, the solution to the above-noted problem is to create a line of sight that substantially fits an extended portion of the arrow flight curve that is of most interest to the hunter or archer. For example and in the northeastern part of the United States, a typical target range for hunting is between about ten and thirty yards (meters). In this regard, it is most difficult to judge distance and risky to shoot much beyond thirty yards (meters) and seldom do hunters get closer than ten yards (meters) to their prey. The line of sight that best fits the arrow flight curve, just described, is therefore a line that crosses the path of arrow flight slightly beyond the ten yard (meter) mark and slightly before the thirty yard (meter) mark. This line is a downward sloping sight line that closely matches the curved path of arrow flight from the apex of the arrow path to the target and significantly reduces the error between the aiming sight view and the path of the arrow over the range. The created sight line is the best fit line to approximate the curve of the given range of distance.

To enable this line of sight, it is necessary to create an elevated line of sight emanating from above the arrow at the bow. In accordance with this invention, a set of mirrors are arranged, such as in a periscope, to create the required elevation. According to at least one version, the mirror set is mounted along with an aiming point pin to the bow in the same manner as a typical aiming pin sight. In this version, the adjustments for aiming are the same as described for typical bow sights in that the pin must be aligned with the hunters' eye to create a line to the target. The difference between a traditional aiming arrangement and the present invention is that that the line being viewed through the mirrors closely matches that of an extended portion of the arrow path of flight, correspondingly creating an extended accuracy range. Thus, only a single pin or other aiming point indicator is required for the entire range.

According to at least one aspect, the herein described sight can be releasably or fixedly mounted to a bow and calibrated at a specific target distance for best fit line of sight to the arrow flight curve by means of a windage and elevation (left/right and up/down) device in the same manner that a traditional bow aiming point sight is calibrated. Once calibrated, the bow sight will be accurate for an extended accuracy range and without the need to further calibrate the sight for multiple distances. That is to say, no further adjustments are required following an initial one time calibration.

The extended range of accuracy is defined by a range in which the difference between the aiming sight and arrow flight is less than an acceptable amount of error. Typically, accuracy within about 2 inches (50 cm) is desirable. The herein described device is capable of achieving this goal over a wide range of arrow speeds; typically arrows traveling between 250 to 350 feet per second (fps); that is, about 80 to 110 meters per second (mps). The fitted range of the arrow path is not limited to what is previously mentioned and can be suitable adjusted as needed during a single initial calibration. For example and for slower arrow speeds than those noted above, the accuracy range will be somewhat shorter and for faster arrow speeds, the accuracy range can be further extended.

According to one described embodiment, the vertical separation or spacing between the mirrors of the herein defined periscope for the bow sight is about 4 to 6 inches (10 to 15 cm). It will be understood, however, that this vertical separation can be augmented depending, for example, on the range of distances and arrow speeds. According to one version, the mirror separation can be preset by the manufacturer. According to another version, the bow sight may be built such that the customer can preset or prefix the vertical spacing. The separation choice can be based upon accuracy tolerance and the accuracy range desired for a given arrow speed.

Therefore and according to one version, there is provided an archery bow sight comprising a housing and a pair of mirrors arranged within the housing to create a periscopic view. The mirrors are fixed relative to each other, wherein a raised line of sight is created by the alignment of a user's eye and an aiming point within the periscope view that closely matches a predetermined portion of the flight path of an arrow and thereby providing an extended accuracy range which is defined by the created line of sight.

The herein defined sight can utilize a single aiming point which is useful over the extended accuracy range. Additional aiming points can be used according to one version for targets that are outside of the extended accuracy range.

According to another version, there is provided a method for increasing the accuracy range of a bow. The method comprises the steps of providing a bow sight having a pair of mirrors arranged to create a periscopic arrangement and aligning a line of sight through the pair of mirrors along a predetermined portion of an intended arrow travel path with respect to a target and creating an aiming point that is aligned with the elevated line of sight over the entire portion of the arrow travel path.

According to yet another version, there is provided a sight for a projectile launching device, the sight comprising a housing and a pair of mirrors arranged within the housing to create a periscopic view. The mirrors are fixed relative to each other, wherein a raised line of sight is created by the alignment of a user's eye and an aiming point within the periscope view that closely matches a predetermined portion of the flight path of a launched projectile and thereby providing an extended accuracy range which is defined by the created line of sight.

The elevated line of sight that is created is a best fit extending over the predetermined portion of the intended arrow path, which therein defines the extended accuracy range provided by the sight.

One exemplary object of this application is to fulfill the above-noted needs using a stationary single sight aiming point device.

Another further object is to provide an improved accuracy range sight which is applicable to various bow designs and can be calibrated in cooperation with existing windage and elevation (left/right and up/down) adjustment mechanisms.

Yet another object is to provide an improved accuracy range utilizing a single aiming point sight which closely tracks the trajectory of a launched projectile, such as an arrow, over a range of target distances.

Still a further object of this invention, is to make it as easy for the user of a projectile launching device to hit a desired target with the least amount of complexity and practice.

An advantage of the herein described sight for the bowhunter is that he/she has an accurate line of sight relative to the arrow fight path and is relieved of the need to judge distance to the target.

A further advantage is that a single pin or other aiming point indicator will eliminate the confusion as to which of a multiple number of aiming point pins to sight on, as found in a traditional bow sight. As a result, the herein described sight prevents improper selections of an incorrect aiming point for a given target distance, in which making an accurate decision before shooting the bow can be made when time is of the essence.

Another advantage provided is that the herein described bow sight creates time savings during the calibration process for windage and elevation (left/right and up/down), since calibration is only required for a single aiming point pin at a single target distance rather than having to sequentially calibrate multiple aiming point pins at multiple distances.

Still another advantage is that there are no moving parts to adjust once the initial set-up calibration of the bow sight is completed, allowing the hunter to point and shoot with minimal concern for the equipment.

These and other features and advantages will be readily apparent from the following Detailed Description, which should be read in conjunction with the accompanying drawings.

DETAILED DESCRIPTION

The following description relates to exemplary embodiments for a stationary single aiming point bow sight that effectively and significantly extends the accuracy range of an archery bow. It will be readily apparent, however, that the concepts described herein are equally applicable to other devices capable of launching a projectile at an intended target under the influence of gravity. Throughout the course of discussion, several terms are frequently used in order to provide a suitable frame of reference in regard to the accompanying drawings. These terms, which include "top", "bottom", "upper", "lower" and the like are not intended to restrict the overall scope of the invention, including the appended claims, except where so specifically indicated. In addition, the accompanying drawings are intended to depict the salient features of the present invention. In this regard, the drawings provided herein are not necessarily drawn to scale.

Figure 1:
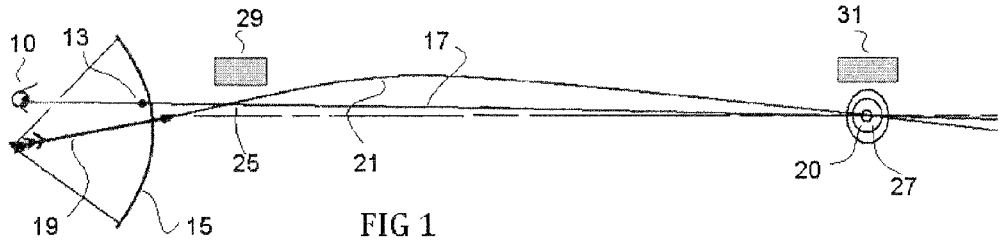
FIG 1 Prior Art
FIG. 1 illustrates a schematic side view of the arrow flight and line of sight of a traditionally known archery aiming point pin sight arrangement.
Figure 2:
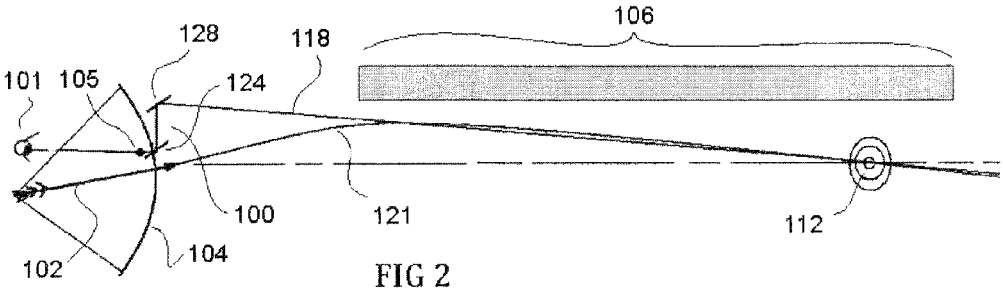
FIG. 2 illustrates a schematic side view of the arrow flight and line of sight using a bow sight made in accordance with the present invention, comparatively illustrating an increase in accuracy range.

Referring to FIG. 2, an exemplary archery bow sight 100 is herein shown schematically, the bow sight 100 being configured to significantly improves the accuracy range (shown as 106) of an arrow 102 as it strikes targets 112 at varying distances, as measured from the archer's bow 104. The improved bow sight 100, FIG. 2, is shown side by side with the traditional bow sight as depicted in FIG. 1, in which the improvement line of sight 118 is depicted relative to a traditional line of sight 17. As previously discussed according to FIG. 1, the traditional line of sight 17 intersects with the arrow path 21 at only two points of accuracy 29, 31 in which the arrow path 11 intersects the sight axis 17 of the bow 15. The improved bow sight 100, on the other hand, is based on the concept of creating an aiming line of sight 118 that is an approximate fit with a significant portion of the curved arrow path 121, which defines an extended accuracy range 106.

Figure 3:
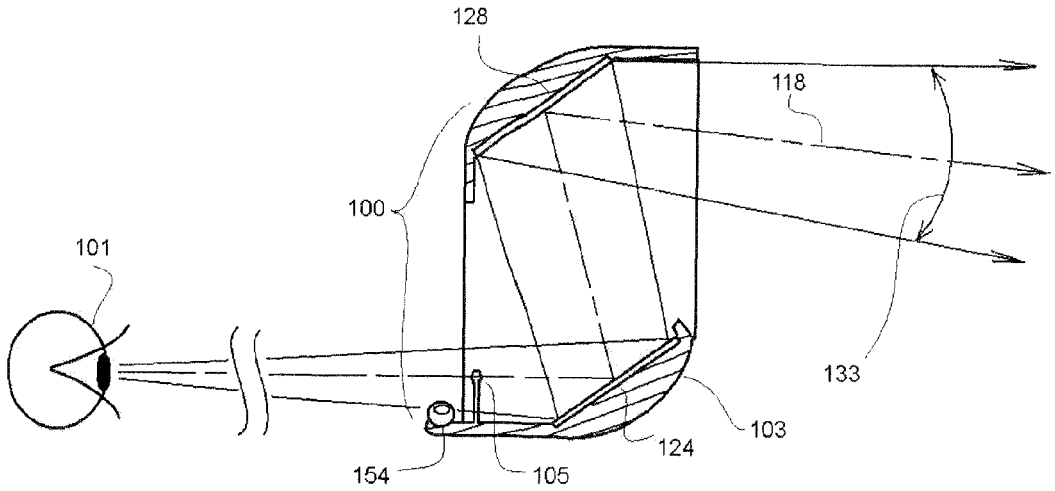
FIG. 3 is an illustrated cross-section of an exemplary bow sight of the present invention.

With continued reference to FIGS. 2 and 3, the bow sight 100 is further described. In brief, a line formed by the eye 101 of the archer and a stationary aiming point indicator, such as aiming point pin 105, creates a line of sight 118. This line of sight 118 is caused to reflect off a angled lower mirror 124 to an upper mirror 128, each of the mirrors being supported in a housing 103, wherein the line of sight is then directed outwardly toward a target 112 from the bow 104. The mirror set 124, 128 creates a periscope that effectively elevates the line of sight 118 that emanates from the bow 104. The periscopic line of sight 118 is near tangent to the arrow flight curve 121 but, slightly severs the curve with minimal error over the large accuracy range 106.

As noted, the aim point indicator that is used in the herein described bow sight 100 can be a physical standing pin 105 or alternatively can be a reticule or a marking (not shown) that is provided on one of the mirrors 124, 128 to enable easy reference by the archer. In that regard, it is desirable for the aim point to stand out for visualization, such as by illumination of the aim point. For example, radium or other absorbing and fluorescing material can be used for this purpose. The aiming point pin 105 may also be defined by the end of a fiber optic that glows brightly for visualization by means of absorption of ambient light. This aim point also may be alternatively transmitted through from the backside of either the lower mirror 124 or upper mirror 128 of the defined sight 100. Commonly, fiber optics are made to glow by means of black light during low ambient light conditions.

Figure 4:
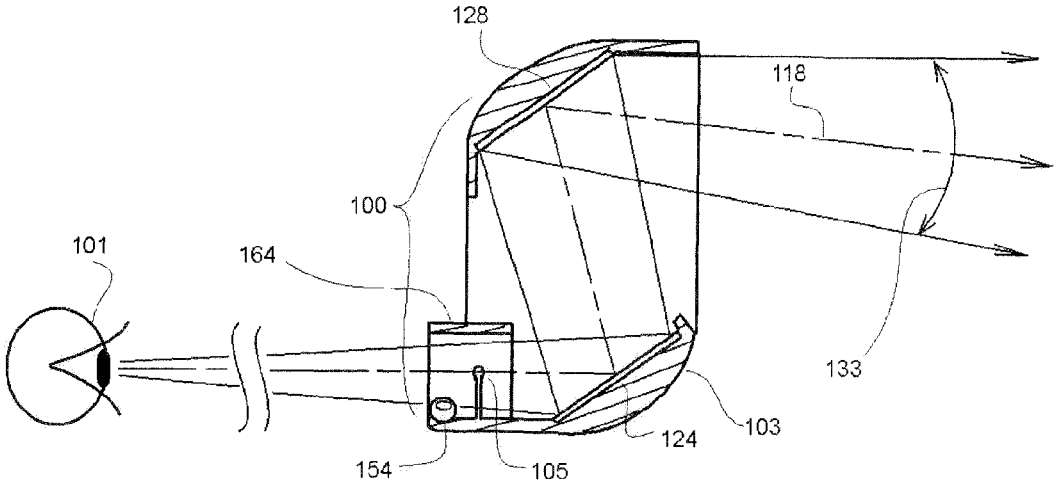
FIG. 4 is an illustrated cross-section of a bow sight made in accordance with another exemplary embodiment, further including a ring that is disposed about the aiming point of the bow sight.

Referring to FIGS. 3 and 4, a bubble level 154 can be added near the line of sight 118 to aid the hunter in holding the bow 105 in a suitable vertical position.

Figure 6:
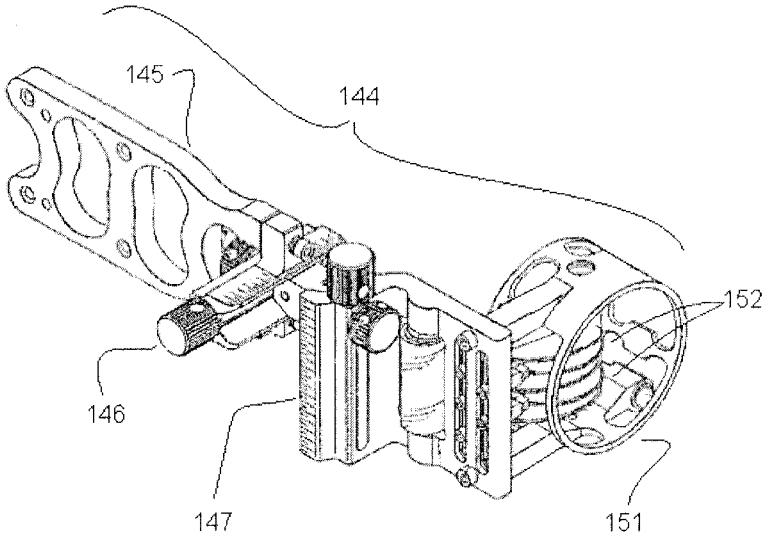
FIG 6 Prior Art
FIG. 6 is a perspective view of an elevation and windage (left/right and up/down) mechanism with a traditional multi-pin bow sight attached.

It may be advantageous or convenient to add a fine tuning elevation and windage adjustment (not shown) to the aiming point pin 105 separate from a primary windage and elevation mechanism 144-147, such as the mechanism which is shown in FIG. 6.

In terms of an arrow flight path and for purposes of this described embodiment, a typical arrow speed of about 300 feet per second (100 meters per second (mps)) will raise about 4 inches (10 cm) mid-range in flight to a target at 30 yards (30 meters). Using a sight 100 having a vertical spacing of about 4 inches (10 cm) between the mirrors 124, 128, the sight accuracy to arrow flight will be improved to less than 1.0 inch (2.5 cm) error over a 10 to 30 yd (10 to 30 m) target distance, which as discussed previously is a prevalent distance range used by bowhunters. Using the same described bow sight 100 with slower speed arrows, the same accuracy can be similarly provided for a substantially proportional and shorter range. For example, 200 fps arrows will be accurate to within about 1.0 inch (2.5 cm) from approximately 7 to 20 yd (7 to 20 m). Conversely, faster arrows will correspondingly push out (expand) the accuracy range almost proportionally. The defined vertical separation of the mirrors 124, 128, along with the arrow speed and the amount that the line of sight 118 severs the arrow flight path 121 will determine the accuracy error size, the location and length of the accuracy range 106.

Figure 5A:
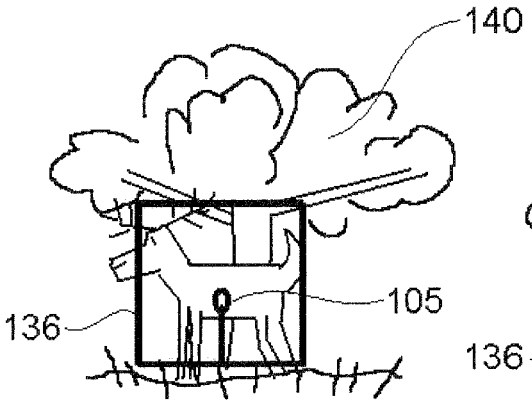
FIG. 5A is an illustration of an image view taken through an exemplary bow sight according to the present invention in which the image view converges with the surrounding view.

Referring to FIG. 5A, the viewing alignment, i.e., the preset angles of the top and bottom mirrors 124, 128, of the herein described bow sight 100, FIG. 3, is fixed such that the view 136 by the archer through the bow sight 100 converges with the surrounding view 140 at a target distance within the accuracy range 104, as shown.

Referring to FIG. 6, a calibration for windage and elevation (left/right and up/down) 144 through 147 are made during calibration set-up, as with all point pin sights 13, FIG. 1, and multi-aiming point pin sights 151. The herein described bow sight 100 is preferably made such that it will mount to right and left handed bows. In a preferable orientation, the attachment location of the bow sight 100 should be provided near the balance point between the mirrors 124, 128 in order to avoid vibration. This mounting, however, will require a dog-leg shape to a mounting bracket in order to use typical standardized bow mounting screw locations.

Though the vertical spacing or separation between the top and bottom mirrors 124, 128 of the bow sight 100 is preferably fixed during use, the housing 103 can be configured such that this spacing can be adjusted, as may be required during manufacture or calibration set-up for the optimization of the line of sight 118 with the arrow flight path 121 given a range of arrow speeds. The adjustment in vertical separation of the mirrors 124, 128 can be accomplished by several methods. For example, the mirrors 124, 128 could be mounted on a slide (not shown) with a locking screw, or the mirror assembly can be rotated to change the vertical separation while maintaining the overall physical separation (angular) between the mirrors. Other suitable means for reliably providing this separation can also be utilized.

In terms of overall construction, the top mirror 128 can be made slightly larger than the bottom mirror 124 so that the resulting view 133 through the bottom mirror 124 is not clipped and also to allow for manufacturing tolerances. The mirrors 124, 128 of the herein described bow sight 100 may literally be of any shape, though most common shape choices can include square, rectangular, circular and/or oval.

Once calibrated, all adjustments are fixed so that the archer can point and shoot the bow using a single aiming point pin 105, FIG. 3. Typically, the angles of each mirror 124, 128 and their relative spacing will be fixed by the sight manufacturer for a common range of arrow speeds and accuracy ranges 106. The only calibration typically required by the archer will be for windage 146, FIG. 6, and elevation 147, FIG. 6. These forms of calibration are typically referred to as "two axis" adjustments. More advanced modern bows have additional adjustments for special cases, thus creating $3^{rd}$, $4^{th}$ and even additional axes adjustments.

Figure 5B:
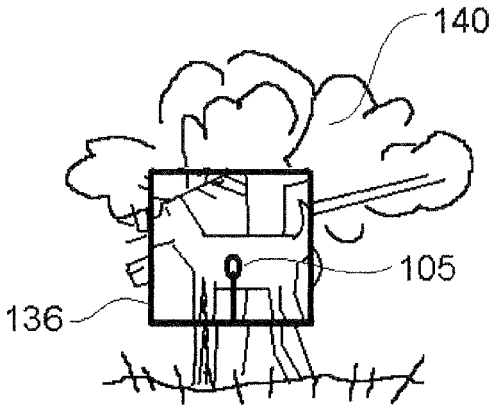
FIG. 5B is an illustration of the image view taken through the bow sight in which the image view does not converge with the surrounding view.

As previously noted and according to FIG. 5A, the image seen through the periscope view 136 by the archer is converged with the surrounding view 140. Convergence can happen at only one location, so it is desirable that convergence occurs within the created accuracy range 106 such that there is little discrepancy from convergence for the hunter during use. FIG. 5B shows the sight (periscopic) image view 136 that is not converged with the surrounding view 140. The image appears disjointed and may be confusing, if it becomes too great.

Referring to FIG. 6, traditional aiming point pin bow sights often include a circular ring 151 surrounding a plurality of aiming point pins 152. The circular ring 151 aids the hunter to align the eye 101, FIG. 4, with the aiming point pin 105 of interest to create the line of sight 118 repeatedly. Referring to FIG. 4, the bow sight 100 can be modified to include a circular ring 164 similar to that of FIG. 6 but for the single aiming pin or indicator. Other techniques used in traditional aiming point bow sights can also be applied to this invention such as adding a large radius to the elevation mechanism 147, FIG. 6, the radii approximating the distance from the aiming point pin to the user's eye at full draw. This is a known technique to improve the perpendicular of the eye 101 to the aiming point pin 105.

Further design considerations to the herein described bow sight can include sealing the housing 103 such that moisture and condensation are limited to external window surfaces. The sealed sight may further require a dry gas fill or moisture absorbing materials. It may also be desirable to provide a protective storage bag or snap on protective hood for when the bow sight is being transported and not used.

It is preferred that the herein described bow sight have a durable and rugged construction, for example, to enable routine use by hunters in the wild. In the herein described version, the sight can be made from a structural molded plastic having glass mirrors. For example, 10 to 30% glass filled, black PC-ABS is a suitable choice. A combination of plastic and metal is also practical, using the metal for structure. Alternatively, the sights can be manufactured from a durable light weight metal such as, but not limited to aluminum alloy, magnesium, and titanium. For example and for a high-end product, the above noted metals could be utilized. First surface mirrors 124, 128 provide the best quality image given that second surface mirrors typically have a faint ghost image reflection from its' non-mirrored first surface. However, second surface mirrors are more robust and economical.

In addition, it is known that bows are often made with a camouflage finish. Therefore and according to one version, providing a camouflage finish on the exterior of the herein described sight will match the bow, thereby making the equipment invisible in the field.

PARTS LIST FOR FIGS. 1-6

10 eye (archer)
13 aiming point pin
15 bow
17 sight axis
19 arrow
20 target
21 curved arrow path
25 first point of intersection
27 second point of intersection
29 accuracy point
31 accuracy point
100 bow sight
101 eye, archer
103 housing
104 bow
105 aiming point pin
106 extended accuracy range
112 target
118 line of sight
121 arrow path
124 top mirror
128 bottom mirror
133 field of view
136 image view (sight)
140 surrounding view
144 calibration mechanism (windage and elevation)
145 calibration mechanism
146 calibration mechanism, windage
147 calibration mechanism, elevation
151 circular ring
152 plurality of aiming points
154 bubble level
164 circular ring (bow sight)

It will be readily apparent that other variation and modifications are possible within the intended ambits of the herein described bow sight, including those recited according to the following claims.

What is claimed is:

1. An archery bow sight comprising:

a housing attachable to an archery bow;

a pair of plano mirrors arranged within the housing to create a periscopic view, the mirrors being fixed relative to each other, wherein a raised single line of sight is created by the alignment of a user's eye covering a range of target distances; and a fixed aiming point within the created periscopic view that closely matches a predetermined portion of the flight path of an arrow over the range of target distances and thereby providing an extended accuracy range which is defined by the created raised single line of sight.

2. The bow sight according to claim 1, wherein a resulting image view through the bow sight converges with the surrounding view at a target distance within the accuracy range.

3. The bow sight according to claim 1, wherein the sight is attachable to a bow by means of a mechanism providing at least windage axis and elevation axis calibration.

4. The bow sight according to claim 1, wherein the fixed aiming point has at least one of independent elevation and windage axis adjustment means.

5. The bow sight according to claim 1, wherein the fixed aiming point comprises at least one of a pin, a reticule and a marking printed on one of the plano mirrors.

6. The bow sight according to claim 1, wherein the fixed aiming point comprises at least one area on the surface of at least one of the mirrors that glows or transmit light through from the backside of the mirror.

7. The bow sight according to claim 1, wherein the fixed aiming spot is illuminated via fiber optic ambient light absorption.

8. The bow sight according to claim 1, wherein the fixed aiming point is illuminated at low light conditions via black light absorption.

9. The bow sight according to claim 1, comprising additional fixed aiming points for targets which are outside of the extended accuracy range.

10. The bow sight according to claim 1, further comprising a bubble level.

11. The bow sight according to claim 1, further comprising at least one feature that permits adjustment of the spacing between the pair of plano mirrors.

12. The bow sight according to claim 1, further comprising a circular ring surrounding and protecting the aiming point to assist the archer in repeatedly creating the line of sight made by the user's eye and the fixed aiming point.

13. The bow sight according to claim 1, wherein the sight is integral to a bow.

14. A method for increasing the accuracy range of a bow, the method comprising:

providing a bow sight having a pair of plano mirrors arranged to create a periscopic arrangement; and aligning a single elevated line of sight through the pair of plano mirrors along a predetermined portion of an intended arrow travel path with respect to a target;

providing a stationary fixed aiming point within the periscopic view created by the pair of plano mirrors that is aligned with the elevated line of sight over the entire predetermined portion of the intended arrow travel path.

15. The method according to claim 14, in which the single elevated line of sight is a best fit extending over the predetermined portion of the intended arrow path.

16. The method according to claim 14, including the step of illuminating the fixed aiming point.

17. The method according to claim 14, including the step of placing the fixed aiming point within a circular ring.

18. The method according to claim 14, wherein the bow sight is at least one of removably attached and integral to a bow.

19. A sight for a projectile launching device, said sight comprising:

a housing; and a pair of plano mirrors arranged within the housing to create a periscopic view, the plano mirrors being fixed relative to each other, wherein a single raised line of sight is created by the alignment of a user's eye; and a fixed aiming point within the periscope view that closely matches a predetermined portion of the flight path of a projectile over a range of target distances along the raised line of sight and thereby providing an extended accuracy range which is defined by the created raised ine of sight.

20. The sight according to claim 19, wherein the projectile launching device is an archery bow.

* * * * *